US010601184B2

(12) United States Patent
Chen et al.

(10) Patent No.: US 10,601,184 B2
(45) Date of Patent: Mar. 24, 2020

(54) HIGH SPEED ELECTRICAL CONNECTOR HAVING DIFFERENT CONDUCTIVE MODULES

(71) Applicant: STARCONN ELECTRONICS (SU ZHOU) CO., LTD, Kunshan, Jiangsu Province (CN)

(72) Inventors: Chih-Wei Chen, New Taipei (TW); Yueh-Lin Yang, New Taipei (TW); Shin-Tai Ho, New Taipei (TW); Yu-Hsiung Lin, New Taipei (TW)

(73) Assignee: STARCONN ELECTRONICS (SU ZHOU) CO., LTD, Kunshan (CN)

( * ) Notice: Subject to any disclaimer, the term of this patent is extended or adjusted under 35 U.S.C. 154(b) by 0 days.

(21) Appl. No.: 16/012,659

(22) Filed: Jun. 19, 2018

(65) Prior Publication Data

US 2019/0305488 A1 Oct. 3, 2019

(30) Foreign Application Priority Data

Apr. 3, 2018 (TW) ..... 107111891 A

(51) Int. Cl.

| | |
|---|---|
| ***H01R 13/6587*** | (2011.01) |
| ***H01R 13/518*** | (2006.01) |
| ***H01R 27/02*** | (2006.01) |
| ***H01R 13/6594*** | (2011.01) |
| ***H01R 13/50*** | (2006.01) |
| ***H01R 13/405*** | (2006.01) |

(52) U.S. Cl.

CPC ..... *H01R 13/6587* (2013.01); *H01R 13/405* (2013.01); *H01R 13/50* (2013.01); *H01R 13/518* (2013.01); *H01R 13/6594* (2013.01); *H01R 27/02* (2013.01)

(58) Field of Classification Search

CPC ..... H01R 13/6585; H01R 13/6586; H01R 13/514

USPC ..... 439/607.05–7

See application file for complete search history.

(56) References Cited

U.S. PATENT DOCUMENTS

| | | | | |
|---|---|---|---|---|
| 6,431,914 | B1 * | 8/2002 | Billman | H01R 23/688 439/607.07 |
| 6,827,611 | B1 * | 12/2004 | Payne | H01R 23/688 439/607.05 |
| 6,872,085 | B1 * | 3/2005 | Cohen | H01R 13/6585 439/108 |
| 6,899,566 | B2 * | 5/2005 | Kline | H01R 13/514 439/108 |

(Continued)

*Primary Examiner* — Tulsidas C Patel
*Assistant Examiner* — Marcus E Harcum
(74) *Attorney, Agent, or Firm* — Yu Gang

(57) ABSTRACT

A transmission wafer includes an insulating frame, a plurality of signal terminals each partially fixed in the insulating frame, and a shielding member fixed on the insulating frame. The insulating frame includes a front end portion and a bottom end portion both substantially perpendicular to each other, and the bottom end portion has a plurality of retaining structures. Each of the signal terminals includes a mounting segment protruding from the bottom end portion, and the shielding member includes a plurality of mounting portions each partially protruding from the bottom end portion. The mounting portions and the mounting segments are arranged in a row, and the mounting portions are respectively retained by the retaining structures of the insulating frame.

19 Claims, 17 Drawing Sheets

(56) References Cited

U.S. PATENT DOCUMENTS 7,074,086 B2 * 7/2006 Cohen ..... H01R 23/688 439/607.08
7,416,447 B1 * 8/2008 Chen ..... H01R 13/6587 439/108
7,585,186 B2 * 9/2009 McAlonis ..... H01R 13/514 439/607.05
7,621,760 B1 * 11/2009 Barr ..... H01R 23/688 439/607.05
7,651,373 B2 * 1/2010 Knaub ..... H01R 13/6471 439/607.05
7,811,128 B2 * 10/2010 Pan ..... H01R 23/688 439/607.03
7,963,806 B1 * 6/2011 Scott Kline ..... H01R 13/642 439/607.08
7,967,637 B2 * 6/2011 Fedder ..... H01R 13/514 439/108
8,021,170 B2 * 9/2011 Pan ..... H01R 13/514 439/108
8,366,485 B2 * 2/2013 Johnescu ..... H01R 13/514 439/607.07
8,398,431 B1 * 3/2013 Whiteman, Jr. ... H01R 13/6587 439/607.06
8,500,487 B2 * 8/2013 Morgan ..... H01R 13/6595 439/607.06
8,550,861 B2 * 10/2013 Cohen ..... H01R 12/58 439/858
8,616,919 B2 * 12/2013 Stoner ..... H01R 13/6587 439/607.07
8,662,924 B2 * 3/2014 Davis ..... H01R 13/6477 439/607.07
9,437,975 B2 * 9/2016 Lee ..... H01R 13/6461
2002/0086582 A1 * 7/2002 Nitta ..... H01R 13/6585 439/607.05
2002/0168898 A1 * 11/2002 Billman ..... H01R 13/514 439/607.07
2003/0143894 A1 * 7/2003 Kline ..... H01R 13/514 439/607.56
2007/0155239 A1 * 7/2007 Nakada ..... H01R 13/514 439/607.1
2007/0155241 A1 * 7/2007 Lappohn ..... H01R 13/514 439/607.07
2008/0280491 A1 * 11/2008 Chen ..... H01R 13/6585 439/607.05
2010/0233906 A1 * 9/2010 Miki ..... H01R 13/514 439/607.55
2012/0214343 A1 * 8/2012 Buck ..... H01R 13/6586 439/607.05
2013/0217263 A1 * 8/2013 Pan ..... H01R 13/6474 439/607.07
2014/0024256 A1 * 1/2014 Davis ..... H01R 13/6587 439/607.05
2014/0148054 A1 * 5/2014 Annis ..... H01R 13/514 439/607.05
2015/0079842 A1 * 3/2015 Pao ..... H01R 13/648 439/607.05
2015/0303618 A1 * 10/2015 Lee ..... H01R 13/506 439/607.05
2016/0134057 A1 * 5/2016 Buck ..... H01R 13/516 439/607.05
2016/0352040 A1 * 12/2016 Pao ..... H01R 4/02
2018/0219329 A1 * 8/2018 Morgan ..... H01R 13/6585

* cited by examiner

HIGH SPEED ELECTRICAL CONNECTOR HAVING DIFFERENT CONDUCTIVE MODULES

BACKGROUND OF THE DISCLOSURE

Field of the Disclosure

The present disclosure relates to a connector; in particular, to an electrical connector and a transmission wafer thereof.

Description of Related Art

A conventional electrical connector includes a plurality of transmission wafers stacked in a row, and each of the transmission wafers includes an insulating frame and a shielding member fastened to the insulating frame. The shielding member includes a plurality of pins protruding from the insulating frame for being inserted into a printed circuit board. However, each of the pins of the shielding member is not supported from any component of the conventional electrical connector, so that when the stacked transmission wafers are mounted to the printed circuit board, the pins of the shielding members are easily deformed by an external force (or the printed circuit board).

SUMMARY OF THE DISCLOSURE

The present disclosure provides an electrical connector and a transmission wafer thereof to solve the drawbacks associated with conventional electrical connectors.

The present disclosure provides an electrical connector, which includes an elongated housing, N numbers of first conductive modules, and M numbers of second conductive modules. A longitudinal direction of the housing defines an arrangement direction. N numbers of the first conductive modules and M numbers of the second conductive modules are inserted into the housing, and are arranged in a row along the arrangement direction. The first conductive module includes a plurality of first transmission wafers stacked along the arrangement direction. The second conductive module includes a plurality of second transmission wafers stacked along the arrangement direction. The structure of each of the first transmission wafers is different from that of each of the second transmission wafers. Each of N and M is a positive integer, and the sum of N and M is equal to or more than three. Each of the first transmission wafers includes a first insulating frame and a plurality of first signal terminals. The first insulating frame includes an elongated first front end portion and an elongated first bottom end portion. A longitudinal direction of the first front end portion is substantially perpendicular to that of the first bottom end portion, and the first bottom end portion has a plurality of retaining structures. Each of the first signal terminals includes a first middle segment, a first contacting segment extending from an end of the first middle segment, and a first mounting segment extending from another end of the first middle segment. The first middle segments are fixed in the first insulating frame, the first contacting segments protrude from the first front end portion and are inserted into the housing, and the first mounting segments protrude from the first bottom end portion. At least a portion of the first transmission wafers of N numbers of the first conductive modules each further includes a first shielding member. The first shielding member includes a first sheet portion, a plurality of first contacting portions extending from the first sheet portion, and a plurality of first mounting portions extending from the first sheet portion. The first sheet portion is fixed on an outer surface of the first insulating frame. The first contacting portions protrude from the first front end portion and are disposed in the housing. Each of the first mounting portions partially protrudes from the first bottom end portion, and the first mounting portions are respectively retained by the retaining structures. The first mounting portions and the first mounting segments are arranged in a row along an inserting direction perpendicular to the arrangement direction.

The present disclosure also provides a transmission wafer of an electrical connector. The transmission wafer includes an insulating frame, a plurality of signal terminals, and a shielding member. The insulating frame includes an elongated front end portion and an elongated bottom end portion. A longitudinal direction of the front end portion is substantially perpendicular to that of the bottom end portion, and the bottom end portion has a plurality of retaining structures. Each of the retaining structures has a retaining channel substantially perpendicular to the longitudinal direction of the front end portion and the longitudinal direction of the bottom end portion. A width of an upper half portion of each of the retaining channels is larger than that of a lower half portion of each of the retaining channels. Each of the signal terminals includes a middle segment, a contacting segment extending from an end of the middle segment, and a mounting segment extending from another end of the middle segment. The middle segments are fixed in the insulating frame, the contacting segments protrude from the front end portion, and the mounting segments protrude from the bottom end portion. The shielding member includes a sheet portion, a plurality of contacting portions extending from the sheet portion, and a plurality of mounting portions extending from the sheet portion. The sheet portion is fixed on an outer surface of the insulating frame, the contacting portions protrude from the front end portion, and each of the mounting portions partially protrudes from the bottom end portion. The mounting portions and the mounting segments are arranged in a row, and the mounting portions are respectively retained by the retaining structures.

In summary, the transmission wafer (e.g., the first transmission wafer) of the present disclosure is provided with the retaining structures formed on the insulating frame (e.g., the first insulating frame), and each of the mounting portions of the shielding member (e.g., each of the first mounting portions of the first shielding member) can obtain a supporting force from being retained by the corresponding retaining structure, so that the mounting portions of the shielding member are not easily deformed by an external force.

In order to further appreciate the characteristics and technical contents of the present disclosure, references are hereunder made to the detailed descriptions and appended drawings in connection with the present disclosure. However, the appended drawings are merely shown for exemplary purposes, and should not be construed as restricting the scope of the present disclosure.

DETAILED DESCRIPTION OF THE EXEMPLARY EMBODIMENTS

First Embodiment

Reference is made to FIGS. 1 to 14, which illustrate a first embodiment of the present disclosure. References are hereunder made to the detailed descriptions and appended drawings in connection with the present disclosure. However, the appended drawings are merely provided for exemplary purposes, and should not be construed as restricting the scope of the present disclosure.

Figure 1:
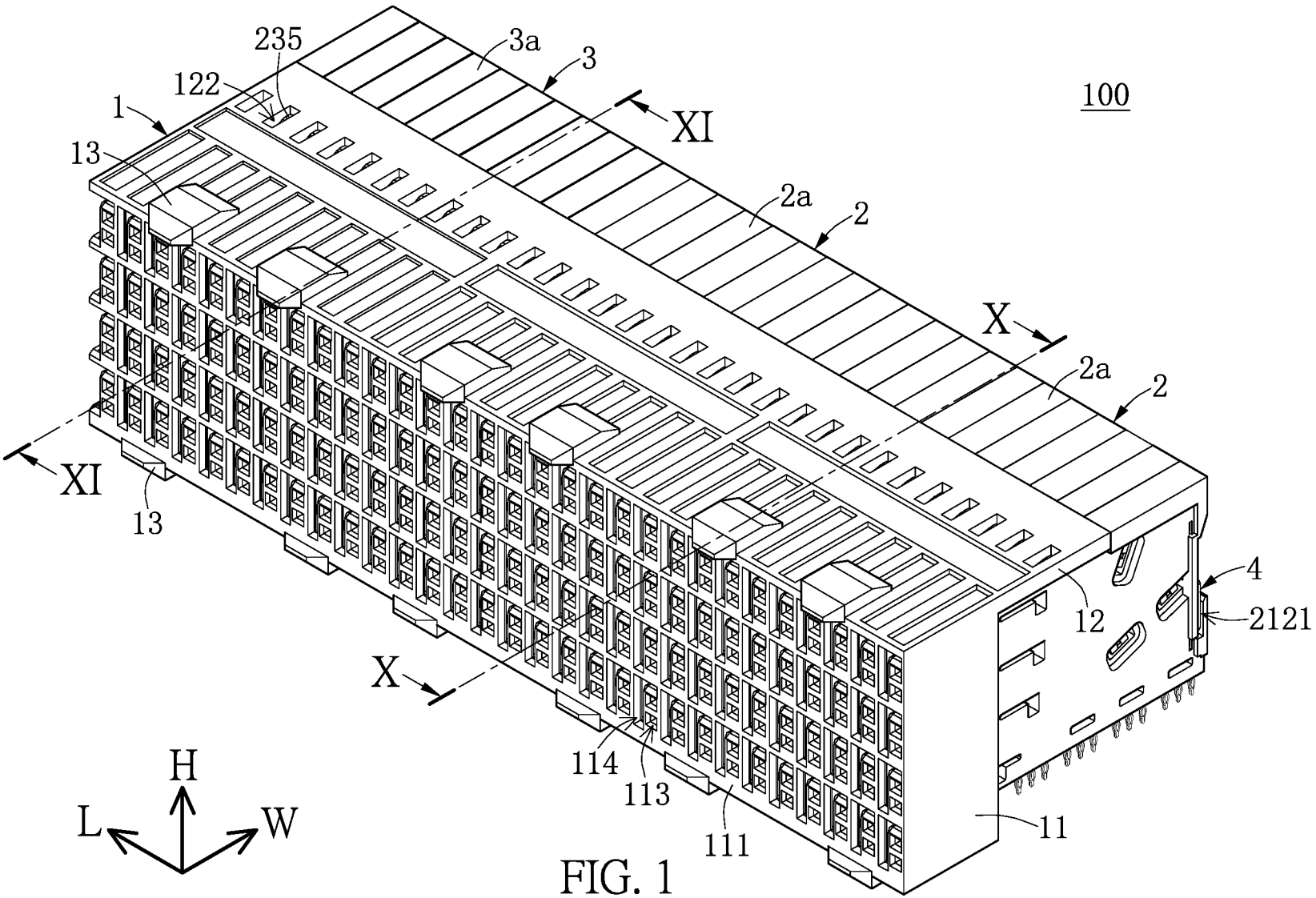
FIG. 1 is a perspective view showing an electrical connector according to a first embodiment of the present disclosure.

As shown in FIG. 1, the present embodiment discloses an electrical connector 100, such as a high speed connector or a backplane connector, but the present disclosure is not limited thereto. In order to clearly express the present embodiment, a length, a width, and a height of the electrical connector 100 that are perpendicular to each other respectively define a longitudinal direction L, a width direction W, and a height direction H. The electrical connector 100 in the present embodiment is an elongated structure having a length to width ratio preferably equal to or more than 2.7, but the present disclosure is not limited thereto.

Figure 2:
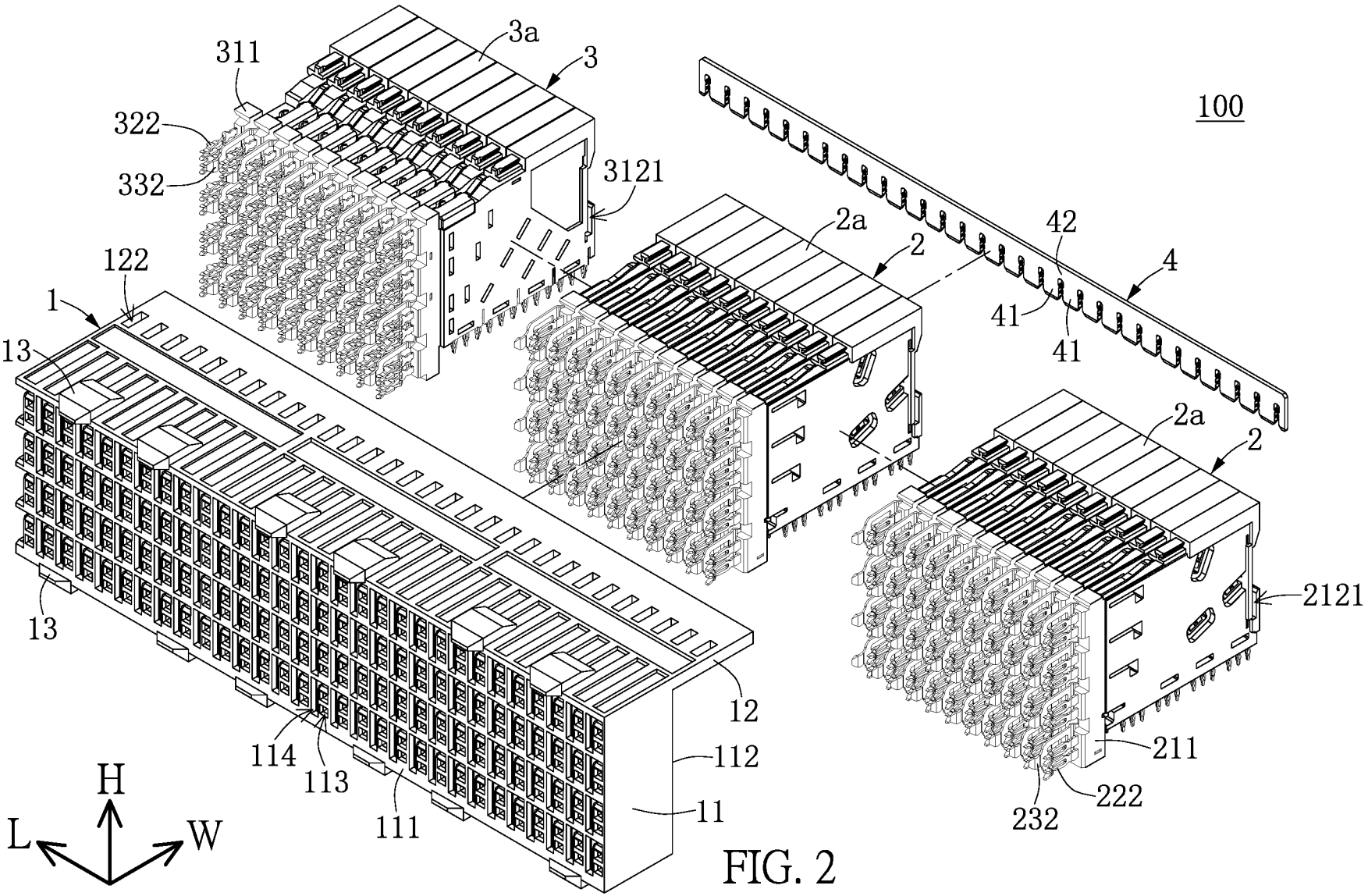
FIG. 2 is an exploded view of FIG. 1.
Figure 3:
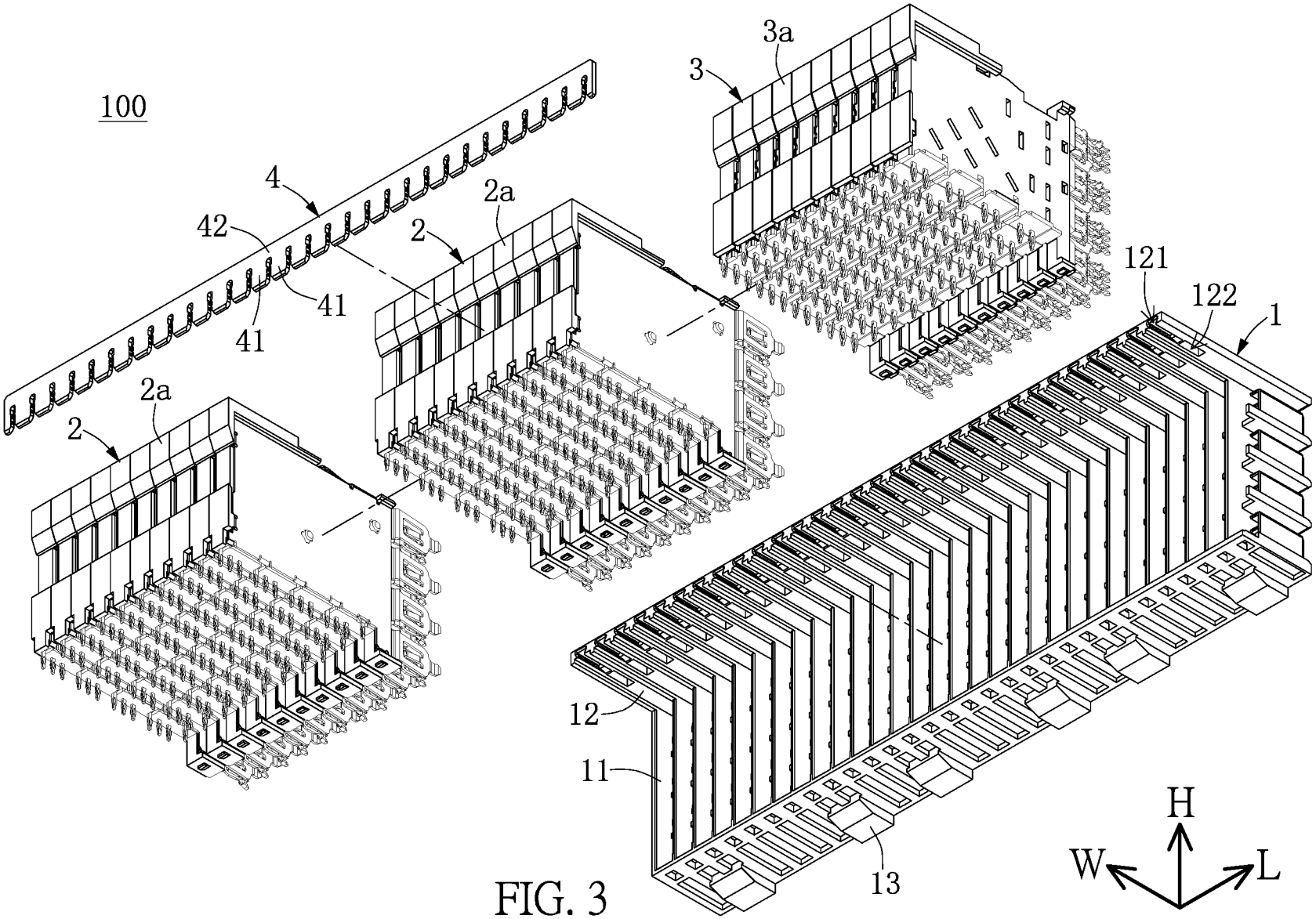
FIG. 3 is an exploded view of FIG. 1 in another perspective.
Figure 4A:
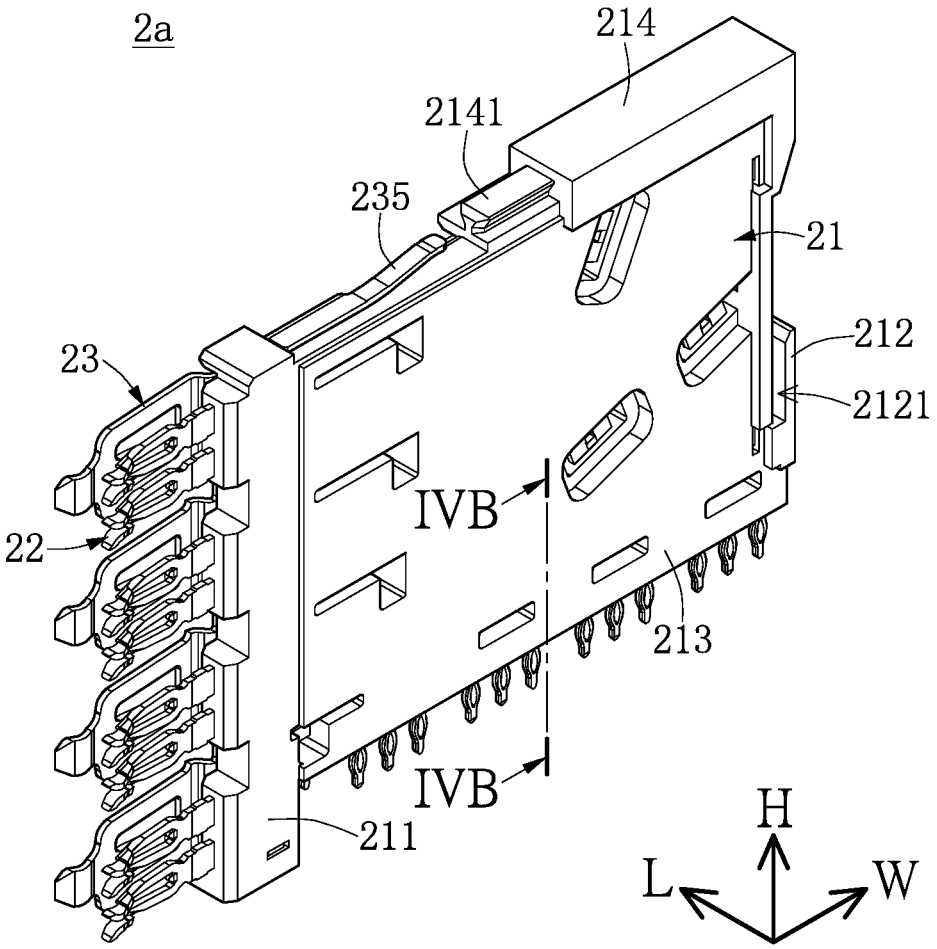
FIG. 4A is a perspective view showing a first transmission wafer according to the first embodiment of the present disclosure.
Figure 4B:
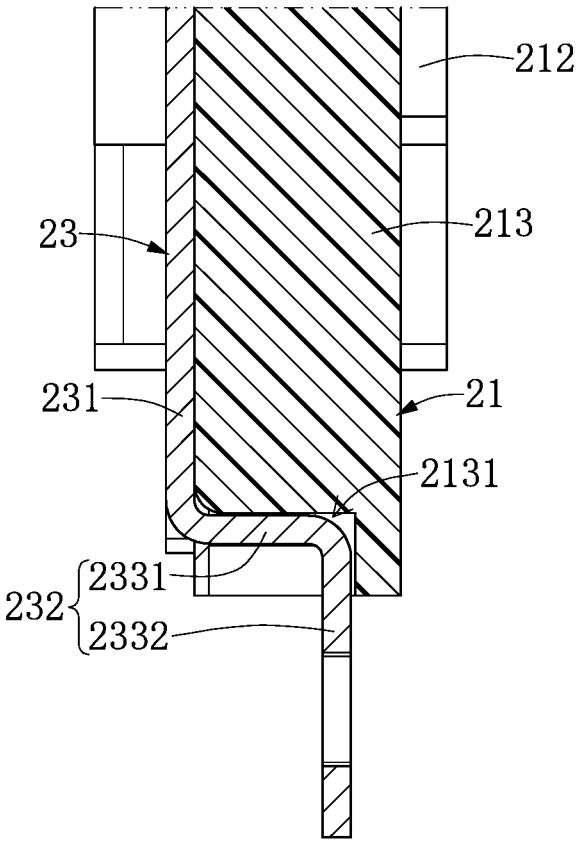
FIG. 4B is a cross-sectional view taken along a cross-sectional line IVB-IVB of FIG. 4A.

As shown in FIGS. 2 and 3, the electrical connector 100 includes a housing 1, N numbers of first conductive modules 2 and M numbers of second conductive modules 3 both inserted into the housing 1, and a beam 4 inserted into N numbers of the first conductive modules 2 and M numbers of the second conductive modules 3. Each of N and M is a positive integer, and the sum of N and M is equal to or more than three. In the present embodiment, the sum of N and M is three, N is two, and M is one, but the present disclosure is not limited thereto. For example, in other embodiments of the present disclosure, N can be one, and M can be two. The following description discloses the structure and connection relationship of each component of the electrical connector 100 of the present embodiment.

Referring to FIGS. 2 and 3, the housing 1 is integrally formed as an elongated structure, and a longitudinal direction of the housing 1 defines an arrangement direction L that is identical to the longitudinal direction L. The housing 1 includes a mating portion 11, an extending plate 12 extending from a top edge of the mating portion 11, and a plurality of guiding columns 13 respectively formed on a top side and a bottom side of the mating portion 11.

The mating portion 11 is an elongated structure parallel to the longitudinal direction L. A ratio of a length of the mating portion 11 (in the longitudinal direction L) to a height of the mating portion 11 (in the height direction H) is preferably equal to or more than 3.5, but the present disclosure is not limited thereto. The mating portion 11 includes a plurality of terminal grooves 113 and a plurality of shielding grooves 114 which are penetratingly recessed from a front end surface 111 to a rear end surface 112 of the mating portion 11 (i.e., along the width direction W). The number of the terminal grooves 113 in the present embodiment is two times of the number of the shielding grooves 114. The terminal grooves 113 are substantially in a matrix arrangement, the shielding grooves 114 are substantially in a matrix arrangement, and the terminal grooves 113 and the shielding grooves 114 are in a staggered arrangement along the longitudinal direction L.

The extending plate 12 is an elongated structure parallel to the longitudinal direction L, and extends from the top edge of the rear end surface 112 of the mating portion 11 along the width direction W. The extending plate 12 has a plurality of engaging slots 121 recessed from a free end thereof, and the engaging slots 121 are arranged in a row parallel to the longitudinal direction L. The extending plate 12 has a plurality of thru-holes 122 respectively arranged adjacent to the engaging slots 121, and the thru-holes 122 are also arranged in a row parallel to the longitudinal direction L.

Each of the guiding columns 13 partially protrudes from the front end surface 111 of the mating portion 11. An arrangement of the guiding columns 13 that are formed on the top side of the mating portion 11 is different from an arrangement of the guiding columns 13 that are formed on the bottom side of the mating portion 11.

As shown in FIGS. 2 and 3, N numbers of the first conductive modules 2 and M numbers of the second conductive modules 3 are inserted into the mating portion 11 of the housing 1, and are arranged in a row parallel to the arrangement direction L. Moreover, the guiding columns 13 in the present embodiment can be defined as N+M groups that respectively correspond in position to N numbers of the first conductive modules 2 and M numbers of the second conductive modules 3 (e.g., as shown in FIG. 2, four of the guiding columns 13 respectively formed on the top-right side and the bottom-right side of the mating portion 11 are defined as a group that corresponds in position to one of the first conductive modules 2, and four of the guiding columns 13 respectively formed on the top-left side and the bottom-left side of the mating portion 11 are defined as a group that corresponds in position to the second conductive modules 3). The first conductive module 2 includes a plurality of first transmission wafers 2*a* stacked along the arrangement direction L, and the outer contours of the first transmission wafers 2*a* are flush with each other along the arrangement direction L. The second conductive module 3 includes a plurality of second transmission wafers 3*a* stacked along the arrangement direction L, and the outer contours of the second transmission wafers 3*a* are flush with each other along the arrangement direction L. Furthermore, the structure of each of the first transmission wafers 2*a* in the present embodiment is different from that of each of the second transmission wafers 3*a*. The following description discloses the structure of the first transmission wafer 2*a* and the structure of the second transmission wafer 3*a*.

In addition, the terms "first" and "second" in the present embodiment are used for distinguishing components, and do not have any structural or order limitation. For example, the "first" transmission wafer 2*a* can be named as a transmission wafer. Moreover, the transmission wafer in the present embodiment can be independently used (e.g., sold) or applied to other connectors, but the present disclosure is not limited thereto.

As shown in FIGS. 2 to 4A and FIG. 7, at least portion of the first transmission wafers 2*a* of N numbers of the first conductive modules 2 each include a first shielding member 23, and at least portion of the second transmission wafers 3*a* of N numbers of the second conductive modules 3 each include a second shielding member 33. It should be noted that if an external surface of N numbers of the first conductive modules 2 and an external surface of M numbers of the second conductive modules 3, which are arranged away from each other along the arrangement direction L, are respectively provided with two shielding members disposed thereon, a side surface of each of the two shielding members is exposed in the air and is not supported by any insulating frame, so that the shielding member disposed on the external surface of the first conductive modules 2 (or the second conductive modules 3) would be easily damaged or broken off. Accordingly, in the electrical connector 100 of the present embodiment, the external surface of N numbers of the first conductive modules 2 and the external surface of M numbers of the second conductive modules 3, which are arranged away from each other along the arrangement direction L, are devoid of any shielding member (e.g., without the first shielding member 23 and the second shielding member 33) disposed thereon, but the present disclosure is not limited thereto.

Referring to FIGS. 4A to 6, as the first transmission wafers 2*a* in the present embodiment are of the same structure, the following description discloses the structure of just one of the first transmission wafers 2*a* for the sake of brevity, but the present disclosure is not limited thereto. For example, in other embodiments of the present disclosure, some of the first transmission wafers 2*a* of N numbers of the first conductive modules 2 can each have one first shielding member 23, while the other first transmission wafers 2*a* may not have any first shielding member 23.

The first transmission wafer 2*a* includes a first insulating frame 21, a plurality of first signal terminals 22 fixed in the first insulating frame 21, and the first shielding member 23 fastened to the first insulating frame 21. In the present embodiment, the first signal terminals 22 of the first transmission wafer 2*a* are a plurality of pairs of differential signal terminals and are fixed in the first insulating frame 21 in an insert-molding manner, and the first shielding member 23 is engaged with the first insulating frame 21, but the present disclosure is not limited thereto.

The first insulating frame 21 is a sheet-like structure substantially perpendicular to the arrangement direction L. The first insulating frame 21 includes an elongated first front end portion 211, an elongated first rear end portion 212 that is opposite to the first front end portion 211, an elongated first bottom end portion 213, and an elongated first top end portion 214 that is opposite to the first bottom end portion 213. A longitudinal direction of the first front end portion 211 is substantially perpendicular to that of the first bottom end portion 213, a longitudinal direction of the first rear end portion 212 is substantially perpendicular to that of the first top end portion 214, and the longitudinal direction of the first front end portion 211 is substantially parallel to that of the first rear end portion 212, but the present disclosure is not limited thereto.

Specifically, the first rear end portion 212 has a first slot 2121 for receiving a part of the beam 4. The first bottom end portion 213 has a plurality of retaining structures 2131, and each of the retaining structures 2131 in the present embodiment is a retaining channel 2131 substantially parallel to the arrangement direction L. In each of the retaining channels 2131, a width of an upper half portion of the retaining channel 2131 is larger than that of a lower half portion of the retaining channel 2131. Moreover, the first top end portion 214 has a first engaging column 2141 for inserting into one of the engaging slots 121 of the housing 1.

Figure 5:
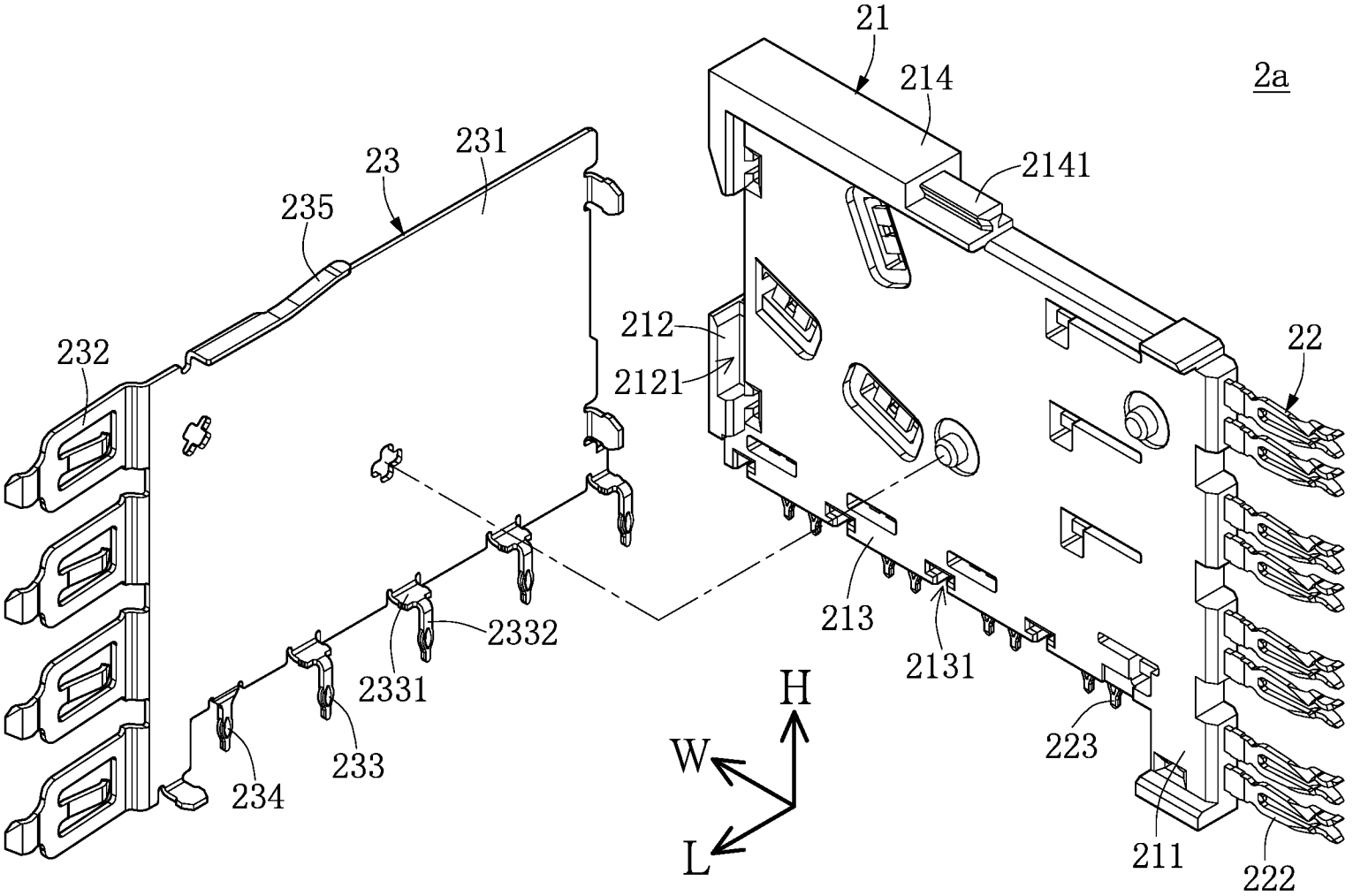
FIG. 5 is an exploded view of FIG. 4A.
Figure 6:
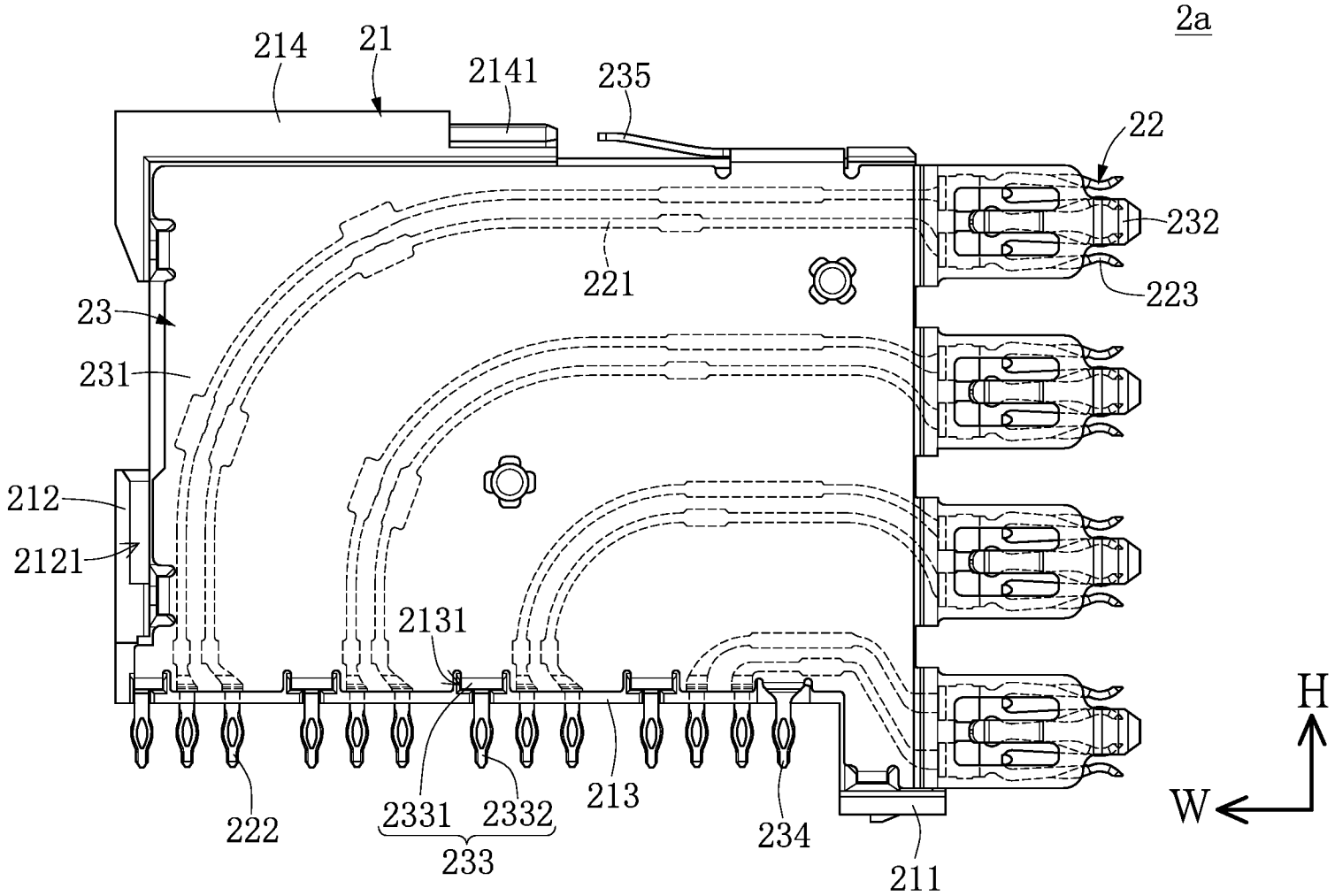
FIG. 6 is a planar view of FIG. 4A.

Each of the first signal terminals 22 includes a first middle segment 221, a first contacting segment 222 extending from an end of the first middle segment 221 (e.g., the right end of the first middle segment 221 as shown in FIG. 5), and a first mounting segment 223 extending from another end of the first middle segment 221 (e.g., the lower end of the first middle segment 221 as shown in FIG. 5). The first middle segments 221 of the first signal terminals 22 are fixed in the first insulating frame 21, the first contacting segments 222 protrude from the first front end portion 211 and are arranged in a row along the height direction H, and the first mounting segments 223 protrude from the first bottom end portion 213 and are arranged in a row along the width direction W.

Specifically, a part of each of the first middle segments 221 is exposed from the first insulating frame 21 and has a width larger than that of the other part of each of the first middle segments 221 embedded in the first insulating frame 21, but the present disclosure is not limited thereto. For example, in other embodiments of the present disclosure, the first middle segments 221 can be entirely embedded in the first insulating frame 21, and each part of the first middle segments 221 can have the same width.

The first shielding member 23 includes a first sheet portion 231 substantially perpendicular to the arrangement direction L, a plurality of first contacting portions 232 extending from a front edge of the first sheet portion 231, a plurality of first mounting portions 233 and an offset mounting portion 234 both extending from a bottom edge of the first sheet portion 231, and a first abutting portion 235 extending from a top edge of the first sheet portion 231. The first sheet portion 231 is fixed on an outer surface of the first insulating frame 21, the first contacting portions 232 protrude from the first front end portion 211 and are arranged in a row along the height direction H, and the offset mounting portion 234 and a part of each of the first mounting portions 233 protrude from the first bottom end portion 213.

Moreover, the first mounting portions 233 and the first mounting segments 223 are arranged in a row along an inserting direction W (that is identical to the width direction W) perpendicular to the arrangement direction L, and the offset mounting portion 234 is arranged at one side of the row of the first mounting portions 233 and the first mounting segments 223. The first mounting portions 233 are respectively retained by the retaining structures 2131 of the first insulating frame 21. Accordingly, each of the first mounting portions 233 of the first shielding member 23 can obtain a supporting force from being retained by the corresponding retaining structure 2131, so that the first mounting portions 233 of the first shielding member 23 are not easily deformed by an external force.

Specifically, each of the first mounting portions 233 includes a flat part 2331 bent with respect to the first sheet portion 231 in a substantial 90 degrees along a first rotation direction and an inserting part 2332 bent with respect to the flat part 2331 in a substantial 90 degrees along a second rotation direction (e.g., a clockwise direction that takes the width direction W as an axis of rotation as shown in FIG. 5) that is opposite to the first rotation direction (e.g., a counterclockwise direction that takes the width direction W as an axis of rotation as shown in FIG. 5). Moreover, in each of the retaining structures 2131 and the corresponding first mounting portion 233, the flat part 2331 is fixed in the retaining channel 2131 (e.g., the flat part 2331 is engaged in the upper-half portion of the retaining channel 2131), and the inserting part 2332 protrudes from the retaining channel 2131.

Figure 7:
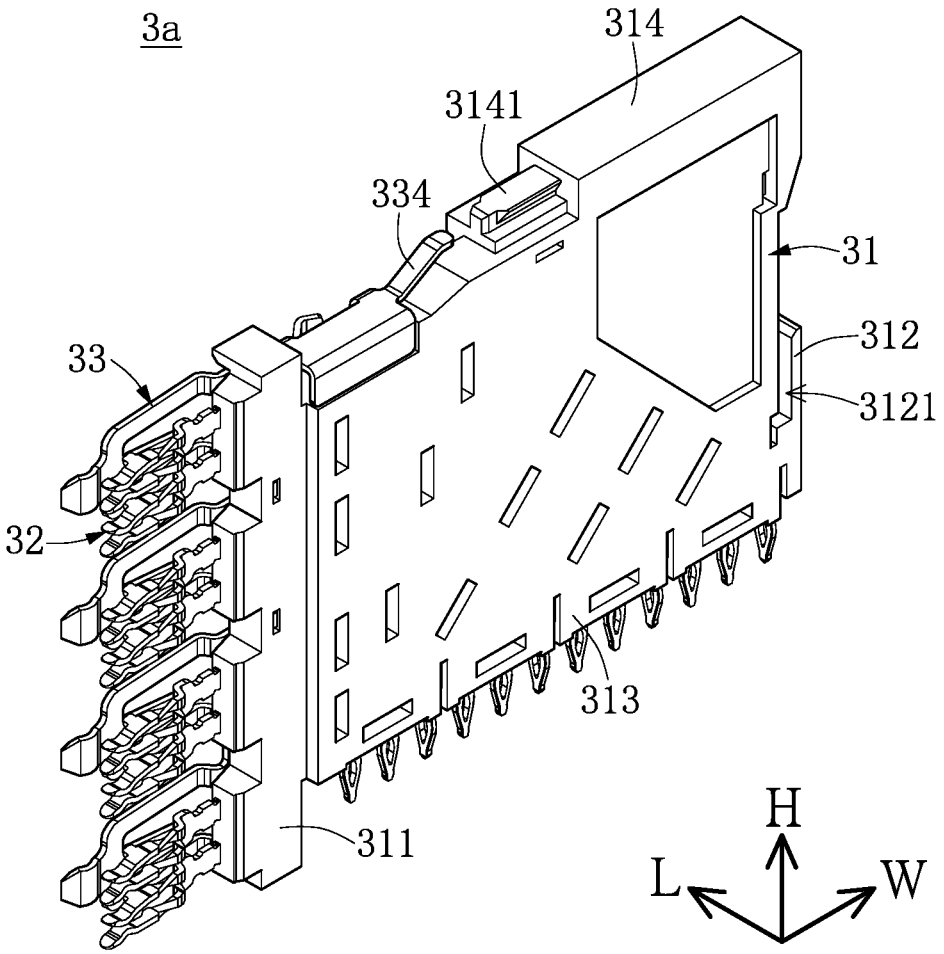
FIG. 7 is a perspective view showing a second transmission wafer according to the first embodiment of the present disclosure.
Figure 8:
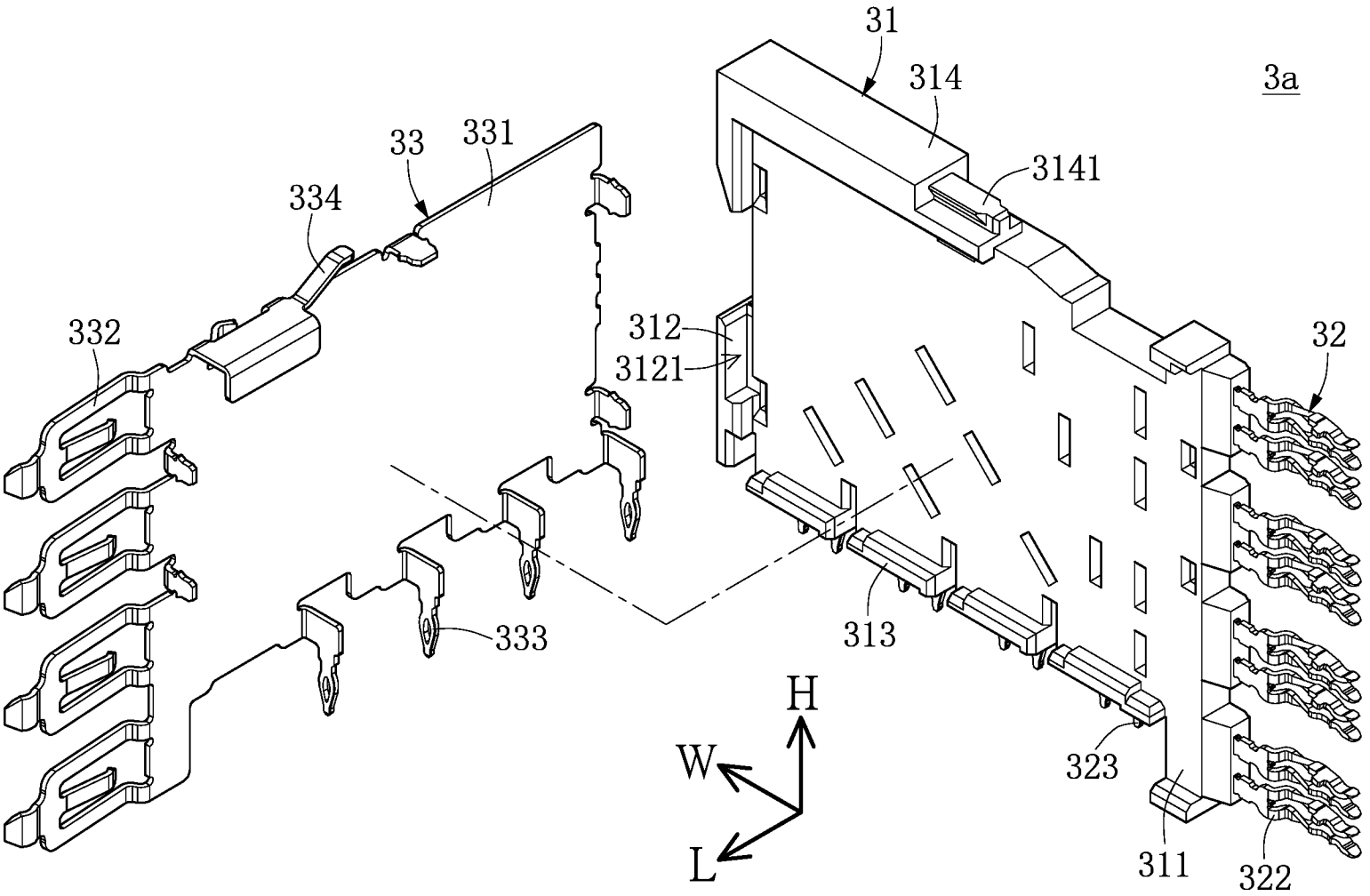
FIG. 8 is an exploded view of FIG. 7.
Figure 9:
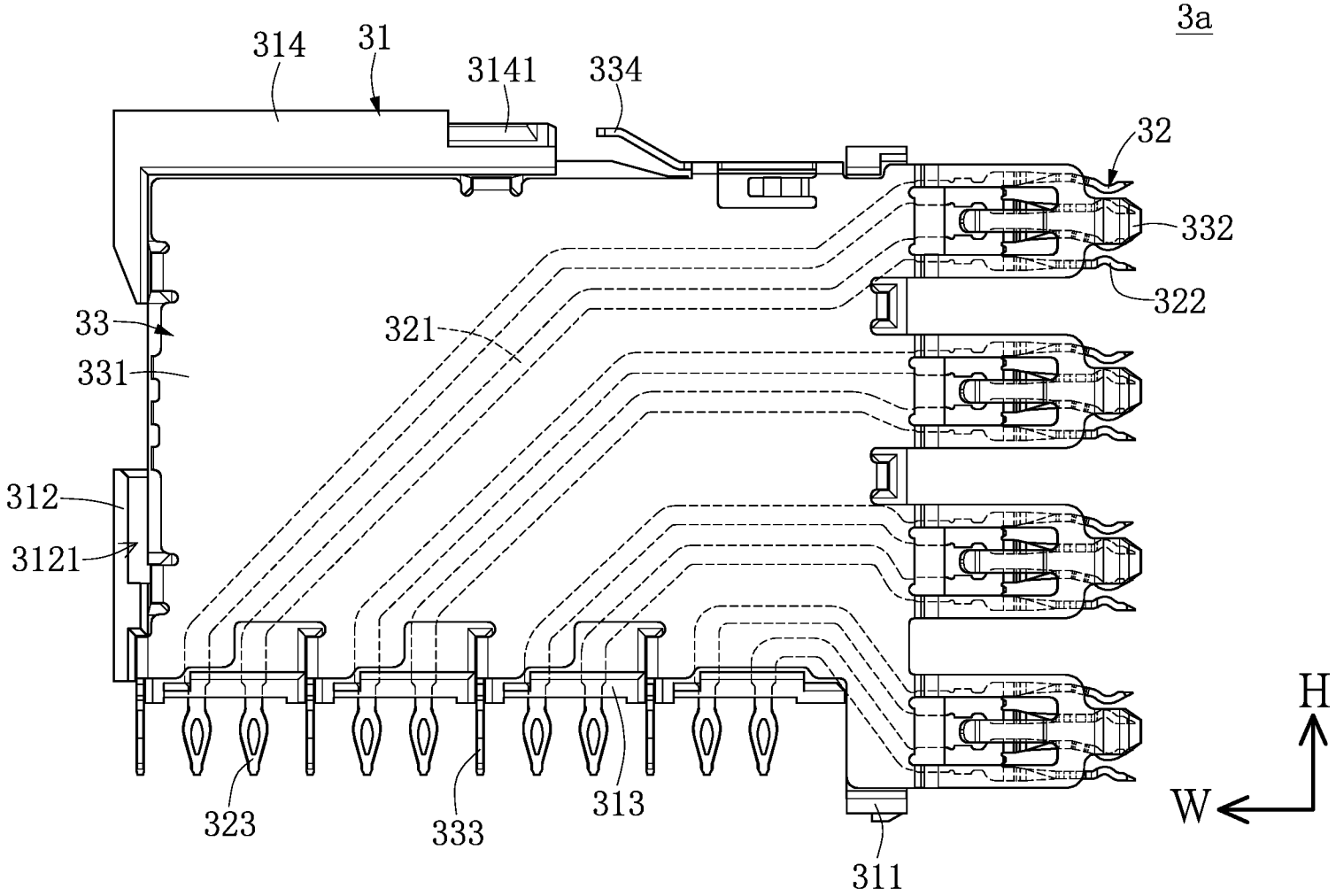
FIG. 9 is a planar view of FIG. 7.

Referring to FIGS. 7 to 9, as the second transmission wafers 3*a* in the present embodiment are almost of the same structure (the outermost second transmission wafers 3*a* does not include the second shielding member 33, and is hence different from the other second transmission wafers 3*a*), the following description discloses the structure of just one of the second transmission wafers 3*a* for the sake of brevity, but the present disclosure is not limited thereto. For example, in other embodiments of the present disclosure, each of the second transmission wafers 3*a* of M numbers of the second conductive modules 3 can have one second shielding member 33.

The second transmission wafer 3*a* includes a second insulating frame 31, a plurality of second signal terminals 32 fixed in the second insulating frame 31, and the second shielding member 33 fastened to the second insulating frame 31. In the present embodiment, the second signal terminals 32 of the second transmission wafer 3*a* are a plurality of pairs of differential signal terminals and are fixed in the second insulating frame 31 in an insert-molding manner, and the second shielding member 33 is engaged with the second insulating frame 31, but the present disclosure is not limited thereto.

The second insulating frame 31 is a sheet-like structure substantially perpendicular to the arrangement direction L. The second insulating frame 31 includes an elongated second front end portion 311, an elongated second rear end portion 312 that is opposite to the second front end portion 311, an elongated second bottom end portion 313, and an elongated second top end portion 314 that is opposite to the second bottom end portion 313. A longitudinal direction of the second front end portion 311 is substantially perpendicular to that of the second bottom end portion 313, a longitudinal direction of the second rear end portion 312 is substantially perpendicular to that of the second top end portion 314, and the longitudinal direction of the second front end portion 311 is substantially parallel to that of the second rear end portion 312, but the present disclosure is not limited thereto.

Specifically, the second rear end portion 312 has a second slot 3121 for receiving a part of the beam 4. The second top end portion 314 has a second engaging column 3141 for inserting into one of the engaging slots 121 of the housing 1.

Each of the second signal terminals 32 includes a second middle segment 321, a second contacting segment 322 extending from an end of the second middle segment 321 (e.g., the right end of the second middle segment 321 as shown in FIG. 8), and a second mounting segment 323 extending from another end of the second middle segment 321 (e.g., the lower end of the second middle segment 321 as shown in FIG. 8). The second middle segments 321 of the second signal terminals 32 are fixed in the second insulating frame 31, the second contacting segments 322 protrude from the second front end portion 311 and are arranged in a row along the height direction H, and the second mounting segments 323 protrude from the second bottom end portion 313 and are arranged in a row along the width direction W.

Specifically, the second middle segments 321 are entirely embedded in the second insulating frame 31, and each part of the second middle segment 321 has the same width, but the present disclosure is not limited thereto. For example, in other embodiments of the present disclosure, a part of each of the second middle segments 321 can be exposed from the second insulating frame 31 and have a width larger than that of the other part of each of the second middle segments 321 embedded in the second insulating frame 31.

The second shielding member 33 includes a second sheet portion 331 substantially perpendicular to the arrangement direction L, a plurality of second contacting portions 332 extending from a front edge of the second sheet portion 331, a plurality of second mounting portions 333 extending from a bottom edge of the second sheet portion 331, and a second abutting portion 334 extending from a top edge of the second sheet portion 331. The second sheet portion 331 is fixed on an outer surface of the second insulating frame 31, the second contacting portions 332 protrude from the second front end portion 311 and are arranged in a row along the height direction H, and a part of each of the second mounting portions 333 protrude from the second bottom end portion 313.

Moreover, the second mounting portions 333 and the second mounting segments 323 are arranged in a row along the width direction W. Specifically, each of the second mounting portions 333 is formed by being bent with respect to the second sheet portion 331 in a substantial 90 degrees along a third rotation direction (e.g., a clockwise direction that takes the height direction H as an axis of rotation as shown in FIG. 8), so that a board surface of the second mounting portion 333 is not coplanar with that of the second mounting segment 323.

Figure 10:
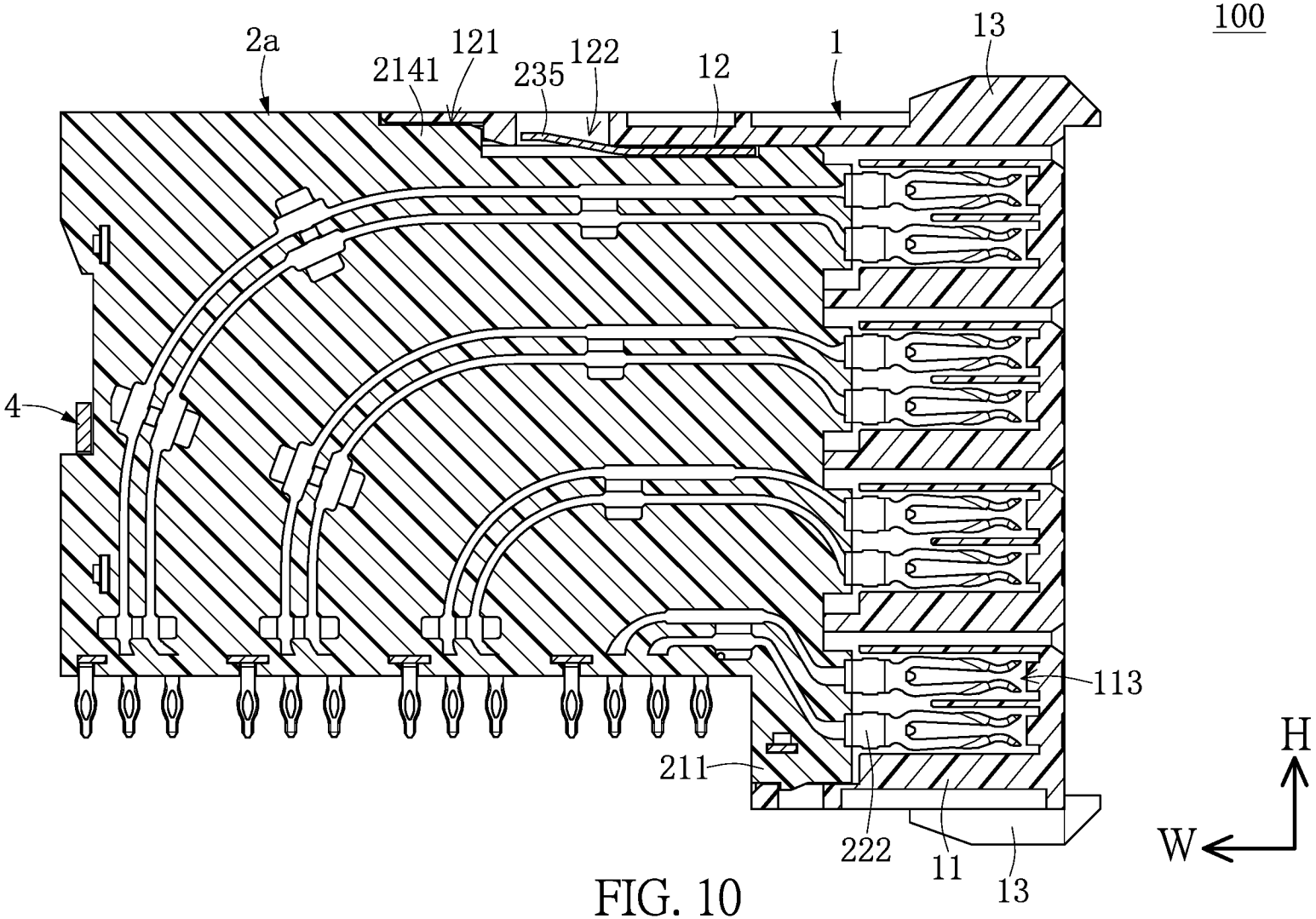
FIG. 10 is a cross-sectional view taken along a cross-sectional line X-X of FIG. 1.
Figure 11:
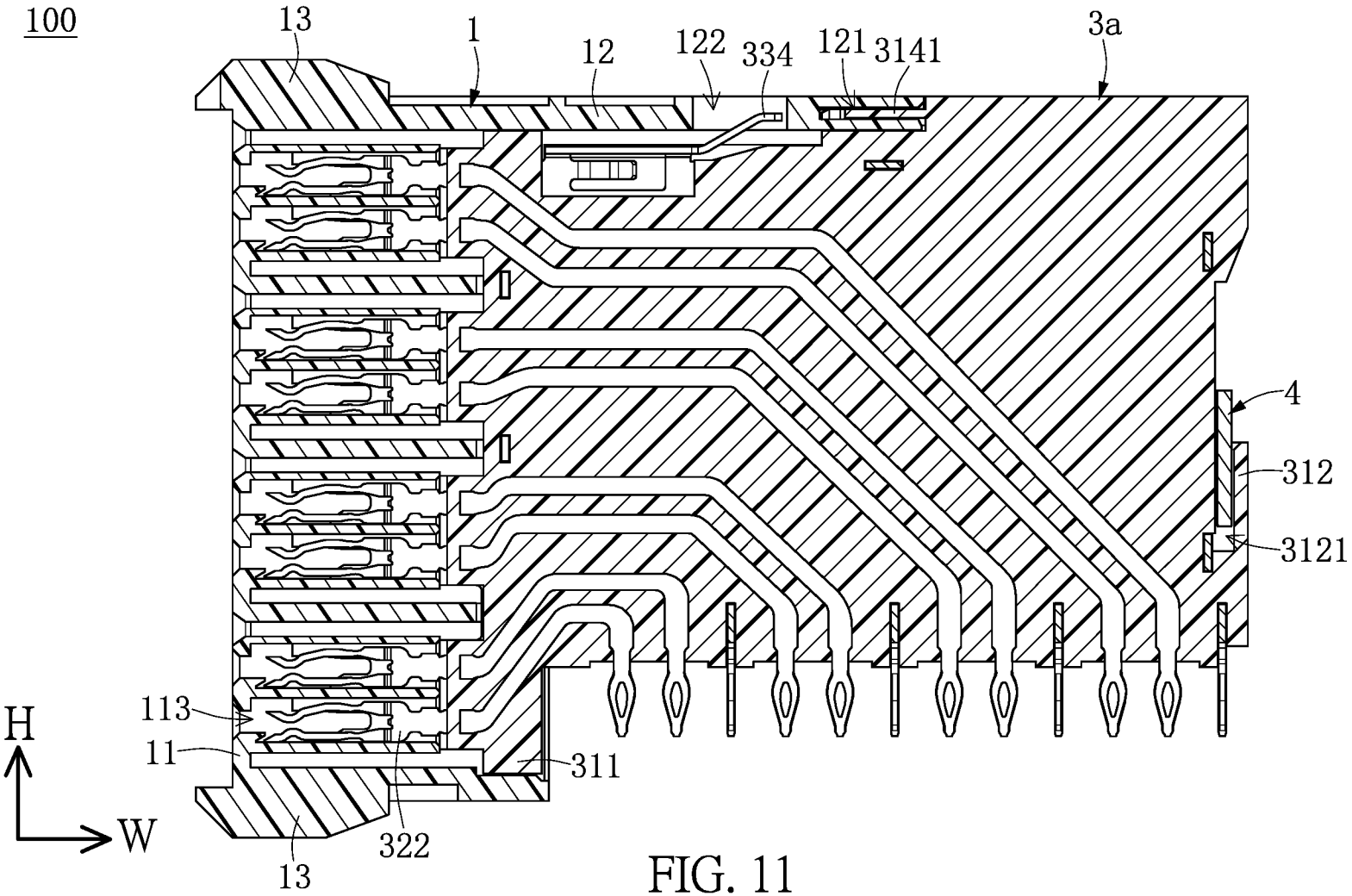
FIG. 11 is a cross-sectional view taken along a cross-sectional line XI-XI of FIG. 1.

In addition, as shown in FIGS. 2, 10, and 11, when the first transmission wafers 2*a* and the second transmission wafers 3*a* are inserted into the housing 1, the first front end portion 211, the first contacting segments 222, and the first contacting portions 232 of each of the first transmission wafers 2*a* and the second front end portion 311, the second contacting segments 322, and the second contacting portions 332 of each of the second transmission wafers 3*a* are respectively inserted into the housing 1. Specifically, the first contacting segments 222 of the first transmission wafers 2*a* and the second contacting segments 322 of the second transmission wafers 3*a* are respectively inserted into the terminal grooves 113 of the mating portion 11, and the first contacting portions 232 of the first transmission wafers 2*a* and the second contacting portions 332 of the second transmission wafers 3*a* are respectively inserted into the shielding grooves 114 of the mating portion 11. Moreover, the first engaging columns 2141 of the first transmission wafers 2*a* and the second engaging columns 3141 of the second transmission wafers 3*a* are respectively inserted into the engaging slots 121 of the extending plate 12. The first abutting portions 235 of the first transmission wafers 2*a* and the second abutting portions 334 of the second transmission wafers 3*a* are respectively arranged in the thru-holes 122 of the extending plate 12.

As shown in FIGS. 1 to 3, the beam 4 is inserted into the first rear end portions 212 of N numbers of the first conductive modules 2 and the second rear end portions 312 of M numbers of the second conductive modules 3. In the present embodiment, the first slots 2121 of the first rear end portions 212 and the second slots 3121 of the second rear end portions 312 are flush with each other along the arrangement direction L, and the beam 4 is inserted into the first slots 2121 and the second slots 3121.

Specifically, the beam 4 is in an elongated shape and is integrally formed as a one-piece structure by punching. A ratio of a length of the beam 4 (in the longitudinal direction L) to a width of the beam 4 (in the height direction H) is preferably equal to or more than 19. The beam 4 includes a plurality of inserting portions 41 and a plurality of connecting portions 42 that are staggered with the inserting portions 41. Each of the connecting portions 42 connects the ends of two of the inserting portions 41 arranged adjacent to each other (e.g., the upper ends of two of the inserting portions 41 arranged adjacent to each other as shown in FIG. 2).

Figure 12:
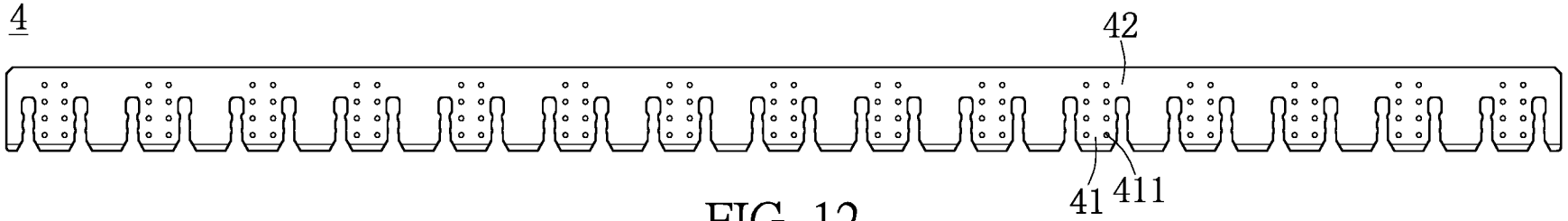
FIG. 12 is a planar view showing a beam being formed with a first flattened structure according to the first embodiment of the present disclosure.
Figure 13:
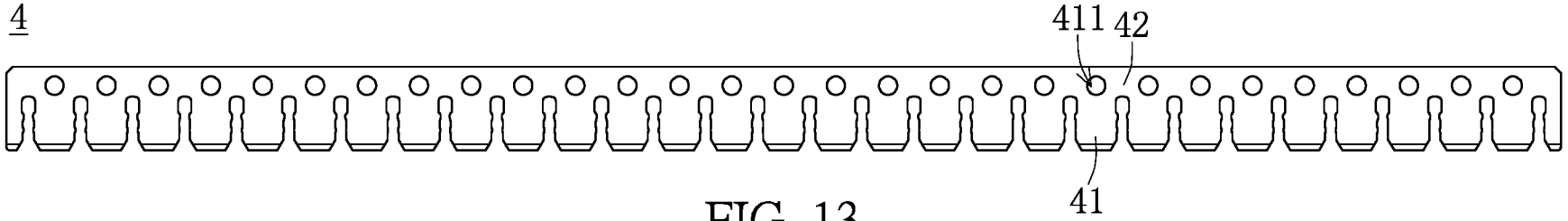
FIG. 13 is a planar view showing the beam being formed with a second flattened structure according to the first embodiment of the present disclosure.
Figure 14:
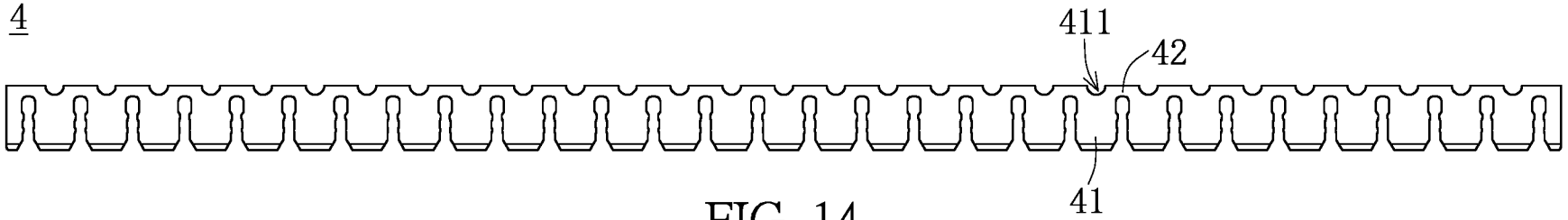
FIG. 14 is a planar view showing the beam being formed with a third flattened structure according to the first embodiment of the present disclosure.
Figure 15:
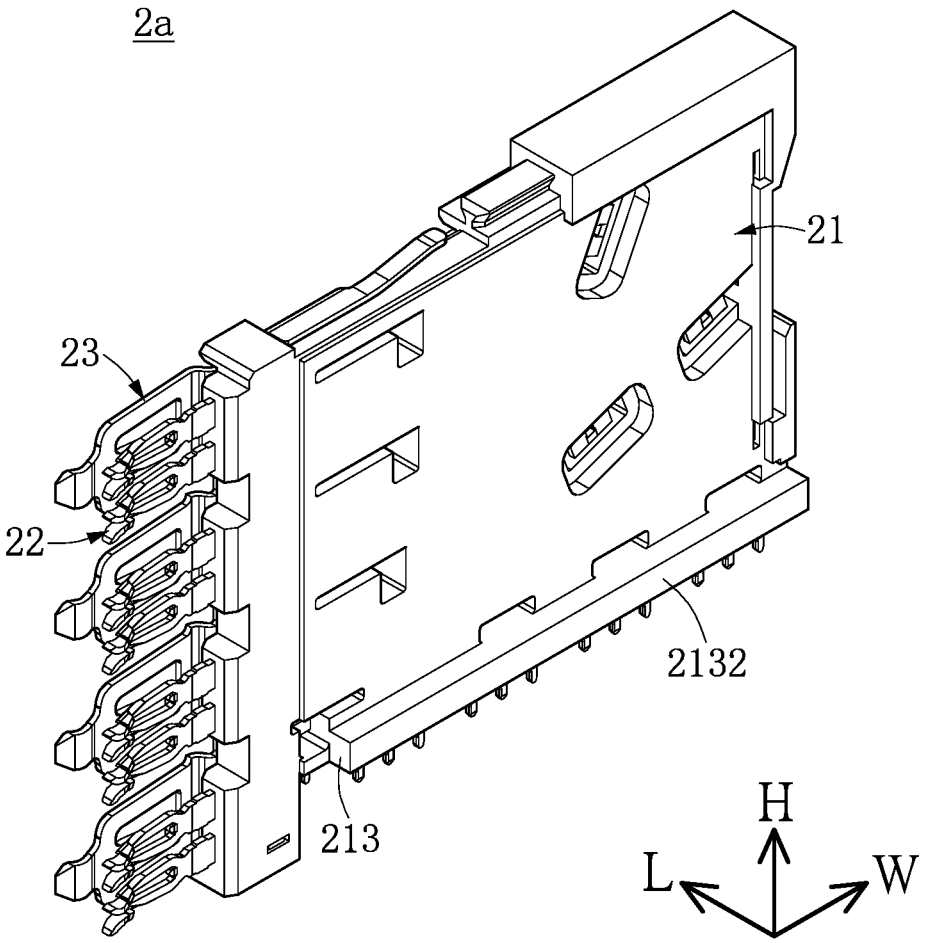
FIG. 15 is a perspective view showing the first transmission wafer according to a second embodiment of the present disclosure.
Figure 16:
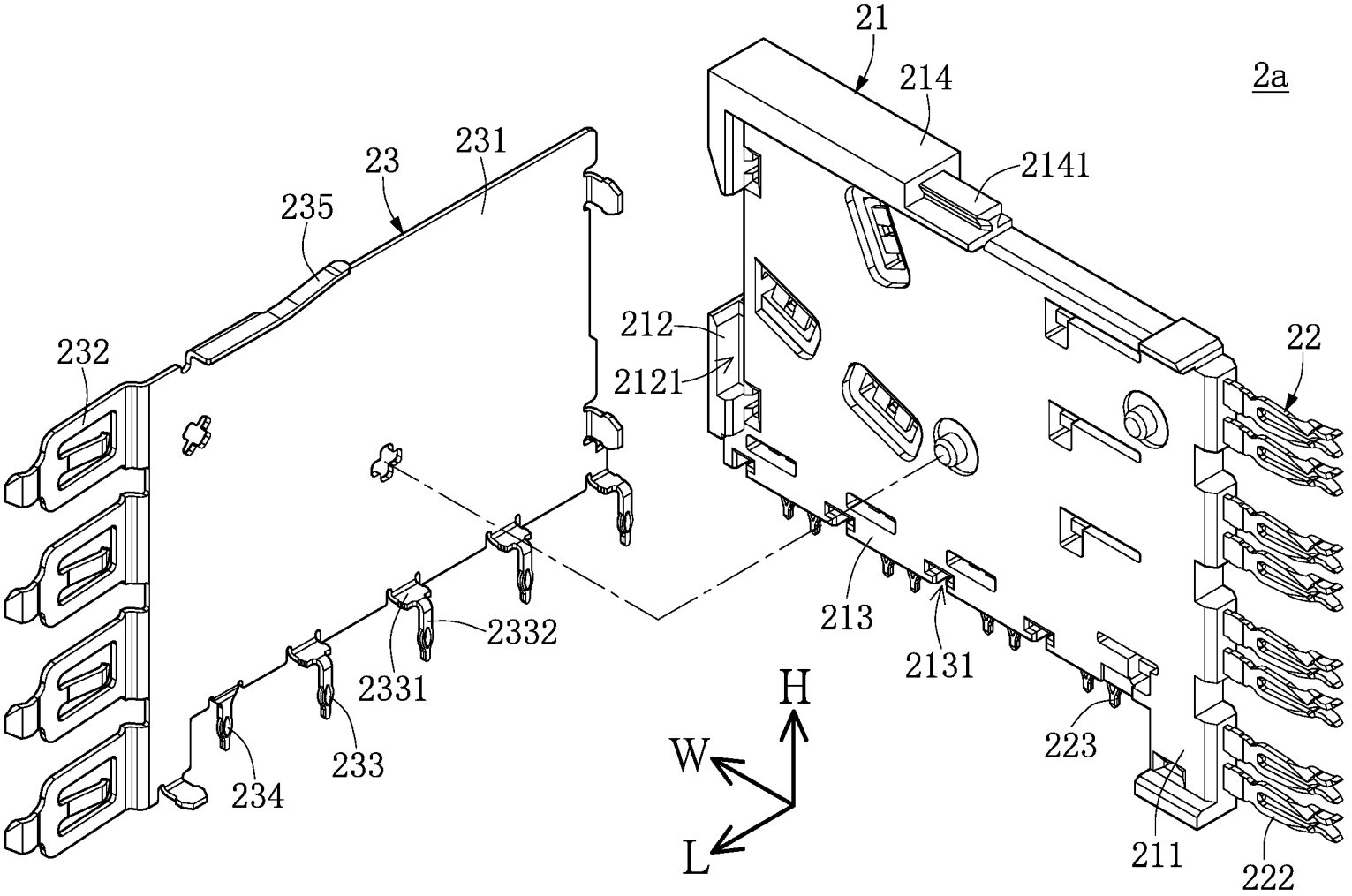
FIG. 16 is an exploded view of FIG. 15.
Figure 17:
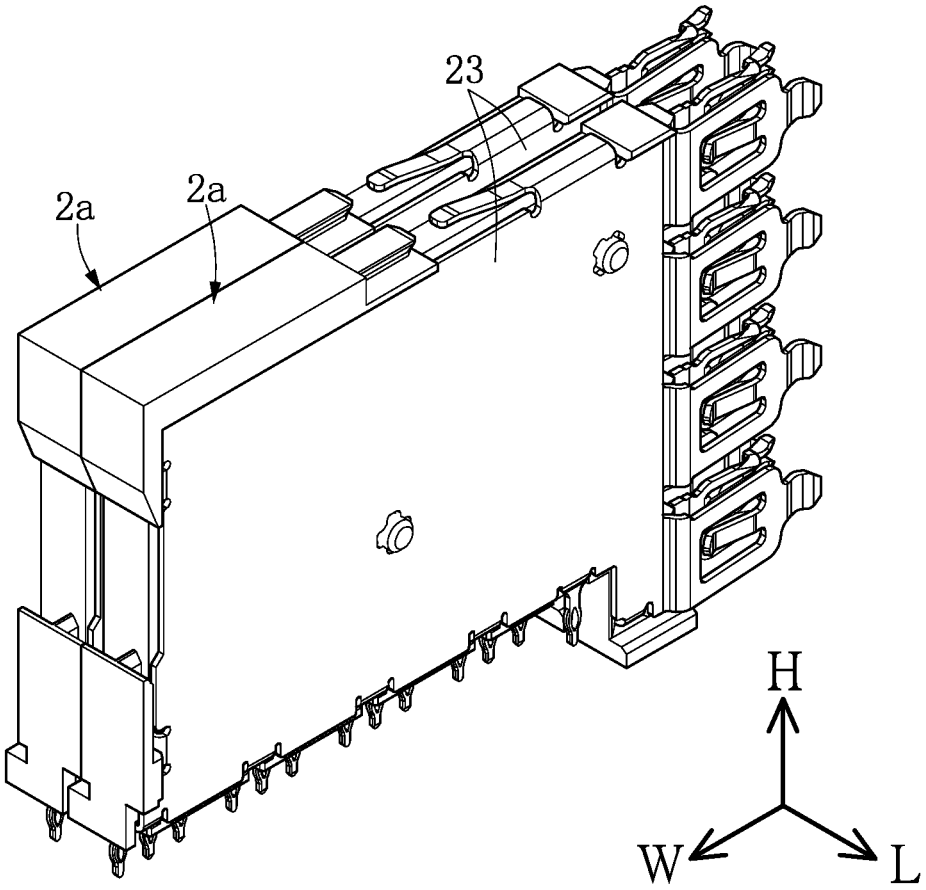
FIG. 17 is a perspective view showing two of the first transmission wafers stacked with each other according to the second embodiment of the present disclosure.
Figure 18:
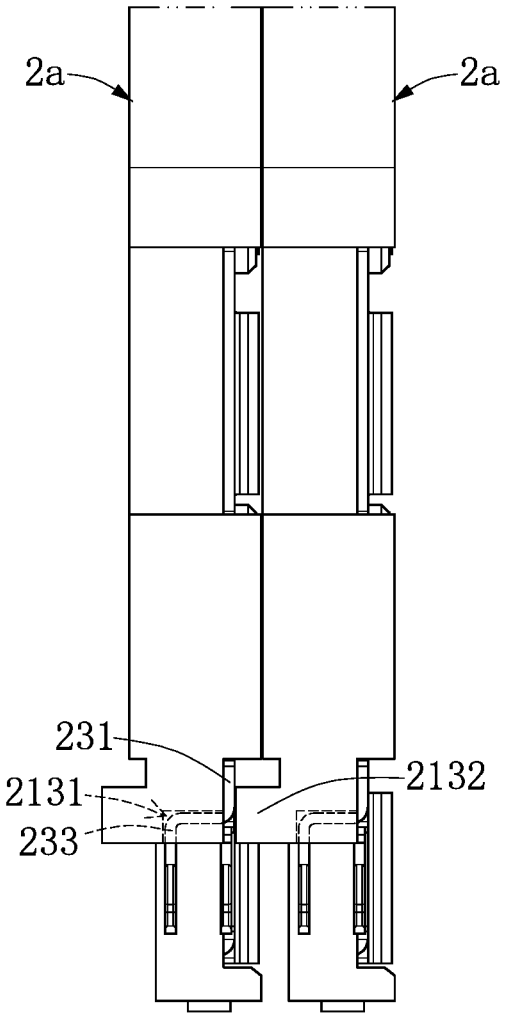
FIG. 18 is a planar view of FIG. 17.

Referring to FIGS. 12 to 14, at least one of the inserting portions 41 is preferably formed with a flattened structure 411 that is formed to enable a longitudinal direction of the beam 4 to be substantially parallel to the arrangement direction L. The flattened structure 411 can be adjusted according to design requirements, and the present disclosure is not limited thereto. For example, the flattened structure 441 includes a plurality of concave points as shown in FIG. 12, a plurality of thru-holes as shown in FIG. 13, or a plurality of concave slots as shown in FIG. 14. Accordingly, the beam 4 of the present embodiment can be formed with the concave points, the thru-holes, or the concave slots for effectively preventing over warpage of the beam 4 with a large length to width ratio after being punched.

Second Embodiment

Reference is made to FIGS. 15 to 18, which illustrates a second embodiment of the present disclosure. The second embodiment is similar to the first embodiment, such that the identical features are not disclosed in the following description. The difference between the second embodiment and the first embodiment resides in the first bottom end portion 213 of the first insulating frame 21.

Specifically, in each of the first transmission wafers 2*a* of the present embodiment, the bottom end portion 213 of the insulating frame 21 has an abutting rib 2132 arranged opposite to the retaining structures 2131. The abutting rib 2132 is in an elongated shape parallel to the width direction W. Moreover, in any two of the first transmission wafers 2*a* arranged adjacent to each other, the abutting rib 2132 of one of the two adjacent first transmission wafers 2*a* abuts against a part of the first sheet portion 231 of the other first transmission wafer 2*a* arranged adjacent to the first mounting portions 233, thereby improving the positioning effect of the first shielding member 23.

Technical Effects of the Present Embodiments

In summary, the transmission wafer (e.g., the first transmission wafer) of the present disclosure is provided with the retaining structures formed on the insulating frame (e.g., the first insulating frame), and each of the mounting portions of the shielding member (e.g., each of the first mounting portions of the first shielding member) can obtain a supporting force from being retained by the corresponding retaining structure, so that the mounting portions of the shielding member are not easily deformed by an external force.

The descriptions illustrated supra set forth simply the exemplary embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. An electrical connector, comprising:

an elongated housing, wherein a longitudinal direction of the housing defines an arrangement direction; and N numbers of first conductive modules and M numbers of second conductive modules both inserted into the housing and arranged in a row along the arrangement direction, wherein the first conductive module is constructed by a plurality of first transmission wafers stacked side by side along the arrangement direction, the second conductive module is constructed by a plurality of second transmission wafers stacked side by side along the arrangement direction, and the structure of each of the first transmission wafers is different from that of each of the second transmission wafers, wherein each of N and M is a positive integer, the sum of N and M is equal to or more than three, and each of the first transmission wafers includes:

a first insulating frame including an elongated first front end portion and an elongated first bottom end portion, wherein a longitudinal direction of the first front end portion is substantially perpendicular to that of the first bottom end portion, and the first bottom end portion has a plurality of retaining structures; and a plurality of first signal terminals each including a first middle segment, a first contacting segment extending from an end of the first middle segment, and a first mounting segment extending from another end of the first middle segment, wherein the first middle segments are fixed in the first insulating frame, the first contacting segments protrude from the first front end portion and are inserted into the housing, and the first mounting segments protrude from the first bottom end portion, wherein at least portion of the first transmission wafers of N numbers of the first conductive modules each further include:

a first shielding member including a first sheet portion, a plurality of first contacting portions extending from the first sheet portion, and a plurality of first mounting portions extending from the first sheet portion, wherein the first sheet portion is fixed on an outer surface of the first insulating frame, the first contacting portions protrude from the first front end portion and are disposed in the housing, and each of the first mounting portions partially protrudes from the first bottom end portion, and wherein the first mounting portions and the first mounting segments are arranged in a row along an inserting direction perpendicular to the arrangement direction, and the first mounting portions are respectively inserted into and bent out of the retaining structures, wherein in any of the first transmission wafers having the first shielding member, each of the first mounting portions includes a flat part bent with respect to the first sheet portion in a substantial 90 degrees along a first rotation direction and an inserting part bent with respect to the flat part in a substantial 90 degrees along a second rotation direction that is opposite to the first rotation direction, and each of the retaining structures has a retaining channel substantially parallel to the arrangement direction, and wherein in each of the retaining structures and the corresponding first mounting portion, the flat part is fixed in the retaining channel, and the inserting part protrudes from the retaining channel.

2. The electrical connector as claimed in claim 1, wherein the first signal terminals of each of the first transmission wafers are a plurality of pairs of differential signal terminals.

3. The electrical connector as claimed in claim 1, wherein in each of the retaining structures and the corresponding first mounting portion, a width of an upper half portion of the retaining channel is larger than that of a lower half portion of the retaining channel, and the flat part is fixed in the upper half portion of the retaining channel.

4. The electrical connector as claimed in claim 1, wherein in each of the first transmission wafers, the first bottom end portion of the first insulating frame has an abutting rib arranged opposite to the retaining structures, and wherein in any two of the first transmission wafers arranged adjacent to each other, the abutting rib of one of the two adjacent first transmission wafers abuts against a part of the first sheet portion of the other first transmission wafer arranged adjacent to the first mounting portions.

5. The electrical connector as claimed in claim 1, wherein each of the second transmission wafers includes:

a second insulating frame including an elongated second front end portion and an elongated second bottom end portion, wherein a longitudinal direction of the second front end portion is substantially perpendicular to that of the second bottom end portion; and a plurality of second signal terminals each including a second middle segment, a second contacting segment extending from an end of the second middle segment, and a second mounting segment extending from another end of the second middle segment, wherein the second middle segments are fixed in the second insulating frame, the second contacting segments protrude from the second front end portion and are inserted into the housing, and the second mounting segments protrude from the second bottom end portion, wherein at least portion of the second transmission wafers of M numbers of the second conductive modules each further include:

a second shielding member including a second sheet portion, a plurality of second contacting portions extending from the second sheet portion, and a plurality of second mounting portions extending from the second sheet portion, wherein the second sheet portion is fixed on an outer surface of the second insulating frame, the second contacting portions protrude from the second front end portion and are disposed in the housing, and each of the second mounting portion partially protrude from the second bottom end portion.

6. The electrical connector as claimed in claim 5, wherein each of the first insulating frames includes a first rear end portion arranged opposite to the first front end portion, and each of the second insulating frames includes a second rear end portion arranged opposite to the second front end portion; wherein the electrical connector further includes a beam inserted into the first rear end portions of N numbers of the first conductive modules and the second rear end portions of M numbers of the second conductive modules; and wherein the beam is integrally formed as a one-piece structure and includes a plurality of inserting portions and a plurality of connecting portions that are staggered with the inserting portions, and at least one of the inserting portions has a flattened structure that is formed to enable a longitudinal direction of the beam to be substantially parallel to the arrangement direction.

7. The electrical connector as claimed in claim 6, wherein the flattened structure of the at least one of the inserting portions includes a plurality of concave points, a plurality of thru-holes, or a plurality of concave slots.

8. The electrical connector as claimed in claim 5, wherein the second signal terminals of each of the second transmission wafers are a plurality of pairs of differential signal terminals.

9. The electrical connector as claimed in claim 1, wherein an external surface of N numbers of the first conductive modules and an external surface of M numbers of the second conductive modules are arranged away from each other along the arrangement direction, and are devoid of any shielding member disposed thereon.

10. The electrical connector as claimed in claim 1, wherein the sum of N and M is limited as three.

11. An electrical connector, comprising:

an elongated housing, wherein a longitudinal direction of the housing defines an arrangement direction; and N numbers of first conductive modules and M numbers of second conductive modules both inserted into the housing and arranged in a row along the arrangement direction, wherein the first conductive module includes a plurality of first transmission wafers stacked along the arrangement direction, the second conductive module includes a plurality of second transmission wafers stacked along the arrangement direction, and the structure of each of the first transmission wafers is different from that of each of the second transmission wafers, wherein each of N and M is a positive integer, the sum of N and M is equal to or more than three, and each of the first transmission wafers includes:

a first insulating frame including an elongated first front end portion and an elongated first bottom end portion, wherein a longitudinal direction of the first front end portion is substantially perpendicular to that of the first bottom end portion, and the first bottom end portion has a plurality of retaining structures; and a plurality of first signal terminals each including a first middle segment, a first contacting segment extending from an end of the first middle segment, and a first mounting segment extending from another end of the first middle segment, wherein the first middle segments are fixed in the first insulating frame, the first contacting segments protrude from the first front end portion and are inserted into the housing, and the first mounting segments protrude from the first bottom end portion, wherein at least portion of the first transmission wafers of N numbers of the first conductive modules each further include:

a first shielding member including a first sheet portion, a plurality of first contacting portions extending from the first sheet portion, and a plurality of first mounting portions extending from the first sheet portion, wherein the first sheet portion is fixed on an outer surface of the first insulating frame, the first contacting portions protrude from the first front end portion and are disposed in the housing, and each of the first mounting portions partially protrudes from the first bottom end portion, and wherein the first mounting portions and the first mounting segments are arranged in a row along an inserting direction perpendicular to the arrangement direction, and the first mounting portions are respectively retained by the retaining structures, wherein in any of the first transmission wafers having the first shielding member, each of the first mounting portions includes a flat part bent with respect to the first sheet portion in a substantial 90 degrees along a first rotation direction and an inserting part bent with respect to the flat part in a substantial 90 degrees along a second rotation direction that is opposite to the first rotation direction.

12. The electrical connector as claimed in claim 11, wherein the first signal terminals of each of the first transmission wafers are a plurality of pairs of differential signal terminals.

13. The electrical connector as claimed in claim 11, wherein each of the retaining structures has a retaining channel substantially parallel to the arrangement direction, and wherein in each of the retaining structures and the corresponding first mounting portion, the flat part is fixed in the retaining channel, and the inserting part protrudes from the retaining channel.

14. The electrical connector as claimed in claim 11, wherein in each of the retaining structures and the corresponding first mounting portion, a width of an upper half portion of the retaining channel is larger than that of a lower half portion of the retaining channel, and the flat part is fixed in the upper half portion of the retaining channel.

15. The electrical connector as claimed in claim 11, wherein in each of the first transmission wafers, the first bottom end portion of the first insulating frame has an abutting rib arranged opposite to the retaining structures, and wherein in any two of the first transmission wafers arranged adjacent to each other, the abutting rib of one of the two adjacent first transmission wafers abuts against a part of the first sheet portion of the other first transmission wafer arranged adjacent to the first mounting portions.

16. The electrical connector as claimed in claim 11, wherein each of the second transmission wafers includes:

a second insulating frame including an elongated second front end portion and an elongated second bottom end portion, wherein a longitudinal direction of the second front end portion is substantially perpendicular to that of the second bottom end portion; and a plurality of second signal terminals each including a second middle segment, a second contacting segment extending from an end of the second middle segment, and a second mounting segment extending from another end of the second middle segment, wherein the second middle segments are fixed in the second insulating frame, the second contacting segments protrude from the second front end portion and are inserted into the housing, and the second mounting segments protrude from the second bottom end portion, wherein at least portion of the second transmission wafers of M numbers of the second conductive modules each further include:

a second shielding member including a second sheet portion, a plurality of second contacting portions extending from the second sheet portion, and a plurality of second mounting portions extending from the second sheet portion, wherein the second sheet portion is fixed on an outer surface of the second insulating frame, the second contacting portions protrude from the second front end portion and are disposed in the housing, and each of the second mounting portion partially protrude from the second bottom end portion.

17. The electrical connector as claimed in claim 16, wherein each of the first insulating frames includes a first rear end portion arranged opposite to the first front end portion, and each of the second insulating frames includes a second rear end portion arranged opposite to the second front end portion; wherein the electrical connector further includes a beam inserted into the first rear end portions of N numbers of the first conductive modules and the second rear end portions of M numbers of the second conductive modules; and wherein the beam is integrally formed as a one-piece structure and includes a plurality of inserting portions and a plurality of connecting portions that are staggered with the inserting portions, and at least one of the inserting portions has a flattened structure that is formed to enable a longitudinal direction of the beam to be substantially parallel to the arrangement direction.

18. The electrical connector as claimed in claim 17, wherein the flattened structure of the at least one of the inserting portions includes a plurality of concave points, a plurality of thru-holes, or a plurality of concave slots.

19. The electrical connector as claimed in claim 16, wherein the second signal terminals of each of the second transmission wafers are a plurality of pairs of differential signal terminals.

* * * * *